United States Patent [19]

Gerlach

[11] 3,976,407

[45] Aug. 24, 1976

[54] FLUID POWER CONVERTER SIDE SEAL

[75] Inventor: Charles R. Gerlach, San Antonio, Tex.

[73] Assignee: Rineer Hydraulics, Inc., Corpus Christi, Tex.

[22] Filed: May 12, 1975

[21] Appl. No.: 576,913

[52] U.S. Cl. ..... 418/142; 418/144; 418/221; 277/96

[51] Int. Cl.[2] ..... F01C 1/00; F01C 19/08; F03C 3/00; F04C 15/00

[58] Field of Search ..... 418/142, 144, 221; 277/96, 96.1

[56] References Cited

UNITED STATES PATENTS

| | | | |
|---|---|---|---|
| 158,222 | 12/1874 | Smith et al. | 418/142 |
| 732,280 | 6/1903 | Draper et al. | 418/144 |
| 2,768,011 | 10/1956 | Mosher | 277/96 |
| 3,016,019 | 1/1962 | Rineer | 418/221 |
| 3,197,126 | 7/1965 | Jungbluth | 418/144 |
| 3,420,584 | 1/1969 | Cannon | 277/96 |
| 3,450,004 | 6/1969 | Ernst | 418/142 |
| 3,506,275 | 4/1970 | Moriyama | 418/142 |
| 3,853,440 | 12/1974 | Green | 418/142 |

*Primary Examiner*—John J. Vrablik
*Attorney, Agent, or Firm*—Fulbright & Jaworski

[57] ABSTRACT

A fluid power converter having a rotor and stator rotatable with respect to one another about a common axis and having coacting sides in which an annular seal is positioned between the coacting sides for limiting fluid flow therethrough thereby providing increased efficiency and maintaining rotor vane fluid loading. Preferably, the center of the annular seal is eccentrically positioned relative to the common axis whereby the seal continuously and periodically changes its radial sealing contact with the side of at least one of the members for providing a long life side seal. An annular retaining ring connected to one of the members and positioned inside of said seal and including a second seal between the inner ring and the annular seal. Resilient means acting between said one member and the annular seal for resiliently urging the annular seal towards the second member.

3 Claims, 6 Drawing Figures

FLUID POWER CONVERTER SIDE SEAL

BACKGROUND OF THE INVENTION

For achievement of high efficiency from a vane-type hydraulic motor, and for proper rotor vane loading, it is desirable to minimize the fluid leakage down the side of the rotor to the motor case, that is the case drain leakage. The case drain leakage can be reduced by utilizing very close operating clearances between the rotor and the stator side housing. However, this is not always a satisfactory solution since large changes in operating temperature, changes in fluid viscosity, axial loading of the motor housing, and other factors can cause galling of the rotor with the stator. This has proved to be a potentially severe problem with large hydraulic motors of the type illustrated in U.S. Pat. No. 3,782,867. In these large motors, a clearance adequate for preventing galling causes high case drain flow and improper loading of the rotor vanes. The latter in turn causes periodic high leakage across the vane tips followed by sudden loading of the rotor vane with a resultant hydraulic shock.

The present invention is directed to providing side seals in a fluid power converter to permit proper pressure loading of the rotor vanes and to provide an improved seal which has a long life and which limits case drain leakage.

SUMMARY

One feature of the present inventon is the provision of a fluid power converter having a rotor and stator which are concentrically mounted and rotatable one to the other about a common axis having coacting sides in which an annular seal is positioned between the coacting sides for limiting fluid flow therethrough for achieving high efficiency and providing proper fluid loading of the rotor vanes.

A still further object of the present invention is the provision of an annular side seal in which the center of the annular seal is eccentrically positioned relative to the common axis of the rotor and stator whereby the seal continuously and periodically changes its radial sealing contact with at least one of the members. The radial motion of the seal provides lubrication on the seal, prevents the seal from drying out and wearing out, and prevents the seal from wearing a groove in its contacting member and increases the life of the seal.

Yet a still further object of the present invention is the provision of a side seal for a fluid power converter which is eccentrically positioned about the converter axis in which resilient means are provided acting between one of the converter members and the seal yieldably urging the seal toward the second member.

Yet a still further object of the present invention is the provision of an eccentrically positioned side seal in which the seal is secured against rotation to one of the fluid converter members but is provided with axial movement to compensate for changes in the clearance between the rotor and stator.

A still further object of the present invention is the provision of an improved eccentrically mounted side seal in a fluid power converter in which an annular retaining ring is connected to one of the members and positioned inside of and eccentrically positions the annular seal in which a second seal means is provided between the retainer ring and the annular seal.

Still a further object of the present invention is the provision of an annular eccentrically mounted side seal in a fluid power converter in which the annular seal includes two annular spaced rails protruding towards one of the converter members and which is resiliently loaded towards the one member.

Other and further objects, features and advantages will be apparent from the following description of presently preferred embodiments, given for the purpose of disclosure and taken in conjunction with the accompanying drawings.

DESCRIPTION OF THE PREFERRED EMBODIMENT

Figure 1:
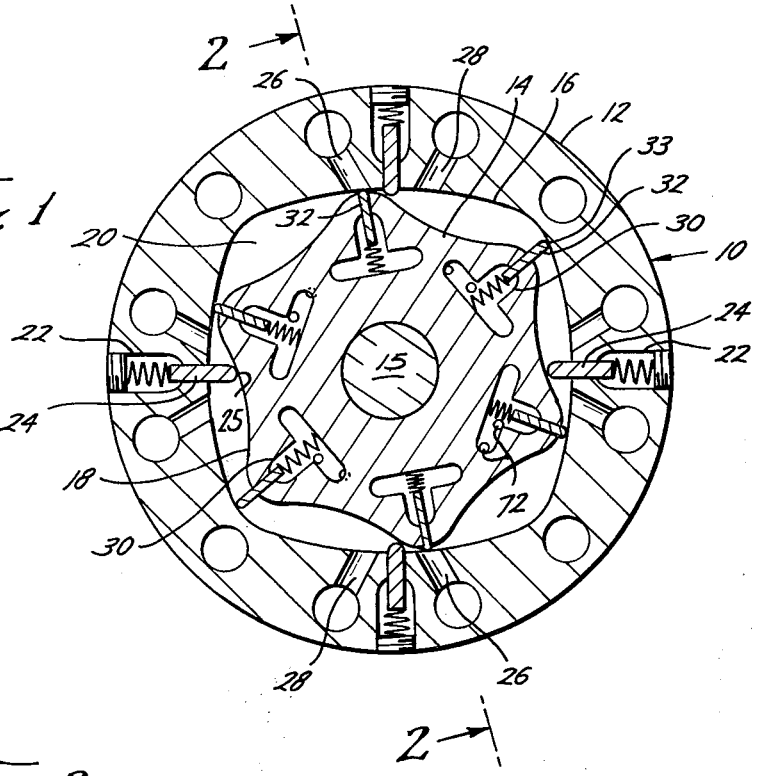
FIG. 1 is a schematic elevational view, in cross section, illustrating one type of fluid power converter which may be utilized with the present invention.

While the present invention will be described in use with a fluid power converter as shown in U.S. Pat. No. 3,782,867 for purposes of illustration, the present invention is useful in other types of fluid power converters. Referring now to the drawings, and particularly to FIG. 1, the reference numeral 10 generally indicates a fluid power converter in which one of the members, such as 12, may be the stator and the other member 14 may be the rotor. The stator 12 and rotor 14 are rotatable relative to each other about a common axis or shaft 15 and are contoured to provide an annular fluid space 20 therebetween.

The stator 12 is shown as including a plurality of radially extending vane receiving slots 22 each of which receives a pressurized loading vane 24 whose outer end 25 contacts the outer periphery 18 of the rotor 14. Similarly, the rotor 14 includes a plurality of equally spaced vane receiving slots 30 each of which receives a pressurized loading vane 32 whose outer ends 33 engage the inner periphery 16 of the stator 12. Fluid passageways 26 and 28 are provided on either side of the vane elements 24 in the stator 12, one of which, such as passageway 26, may be a fluid inlet and the other passageway, such as passageway 28, may be a fluid outlet. Thus, assuming that the fluid power converter 12 is acting as a motor with the fluid coming in the fluid inlet passageways 26 and out of the fluid outlet passageways 28, the rotor 14 will rotate counterclockwise relative to the stator 12.

Pressure loading may be provided on the back of the stator vanes 24 from the high pressure supply ports 26. Hydraulic fluid used for loading the rotor vanes 32 may also be from the high pressure supply ports 26, or from the openings 72 in the side plate 70 at the sides of the rotor 14. For a more detailed description of the motor illustrated in FIG. 1, reference is made to U.S. Pat. No. 3,782,867.

Figure 2:
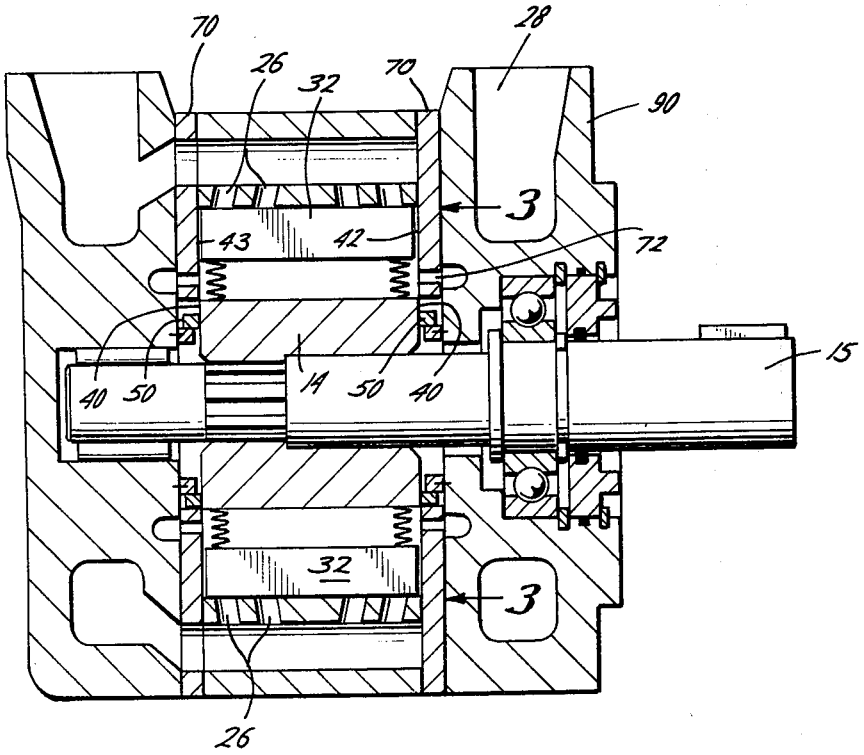
FIG. 2 is a cross-sectional view taken along the line 2—2 of FIG. 1.

However, as best seen in FIG. 2, the high pressure fluid flowing from ports 26 or from ports 72 may leak between the sides 40 of the rotor 14 and the sides of the stator 12, which includes the side plates 70 and end housing 90, to the shaft 15 and this leakage flow is referred to as case drain leakage. While this leakage can be reduced by utilizing very close operating tolerances between the sides 40 and 42 of the rotor 14 and side plates 70, this is not a satisfactory solution since large changes in conditions such as operating temperature, changes in fluid velocity, axial loading on the housing and other factors can cause galling of the sides 40 and 42 if the clearances are too small. However, when the clearance between the sides 40 and 42 is made adequately large enough to prevent galling, then undesirably high case drain flow may occur and improper pressure loading of the rotor vanes occurs which in turn causes high leakage across the vane tips 33 causing sudden loading and unloading of the rotor vanes with a resultant hydraulic shock with low mechanical and volumetric efficiencies. The present invention is directed to providing side seals between the rotor and 14 and stator 12 to limit case drain flow and in particular to insure that the rotor vanes 32 are properly pressure loaded by the hydraulic fluid.

Figure 3:
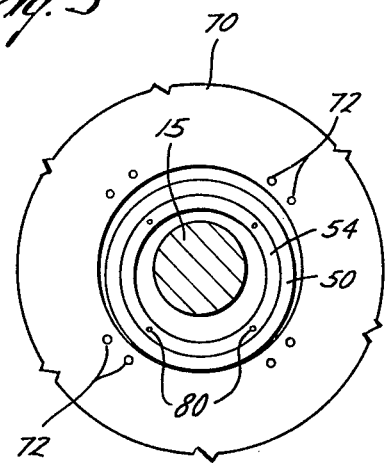
FIG. 3 is a cross-sectional view, taken along the line 3—3 of FIG. 2.
Figure 4:
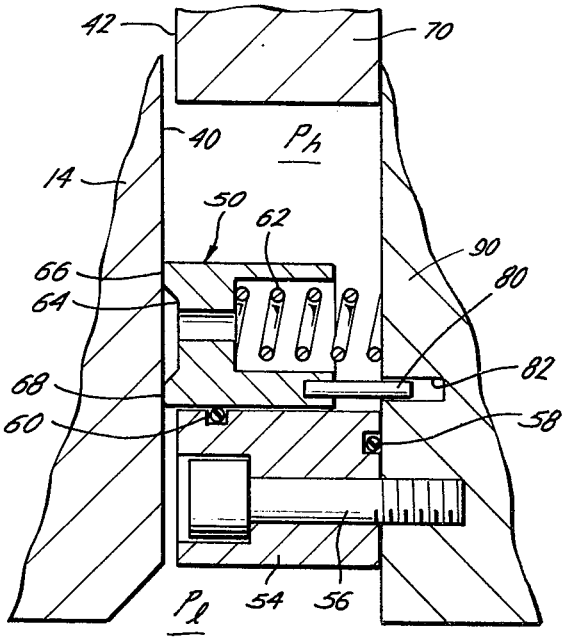
FIG. 4 is an enlarged fragmentary elevational view, in cross section, of the preferred embodiment of the side seal shown in FIGS. 2 and 3.

Referring now to FIGS. 2, 3 and 4, an annular seal, generally indicated by the reference numeral 50, is provided between the sides 40 and 42 of the rotor 14 and side plates 70, respectively. An important feature of the preferred design of the seal 50 is that the annular seal 50 is eccentrically positioned relative to the common axis of the rotor 14 and stator 12 on the shaft 15. The eccentric mounting of the seal 50 prevents the seal 50 from wearing a groove in the rotor side 40 by spreading the wiping or seal action over a more substantial portion of the rotor side 40. This not only reduces wear of the seal and rotor, but induces a minute flow or film of the hydraulic fluid across the face of the seal which prevents the sealing face from drying out and wearing rapidly.

In the preferred embodiment shown in FIG. 4, the seal 50 may be eccentrically positioned between the ends of the rotor 14 and the end housing 90 by providing an annular retainer ring 54 which is eccentrically connected to one of the members, such as end housing 90, by bolts 56 and sealed against the end housing 90 by a suitable seal 58. Therefore, the annular seal 50 may be eccentrically supported about the shaft 15 by the exterior of the retainer ring 54. The space between the seal 50 and the retainer ring 54 may include a suitable seal such as an O-ring 60 to prevent fluid leakage between the seal 50 and the retainer ring 54. Preferably, the annular seal 50 is loaded against the rotor side 40 by resilient means such as a plurality of light springs 62 and hydraulic loading pressure. The face 64 of the seal 50 preferably is of a double rail design having a first rail 66 and a second rail 68 thereby permitting a substantial seal cross section but limiting the actual loaded area to the area of the two rubbing rails 66 and 68. In addition, the seal 50 is axially movable relative to the retainer ring 54, but is preferably stationary relative to the end housing 90 and is prevented from rotation by having one or more pins 80 which engage slots 82 in the end housing 90. The pressure between the sides 40 and 42 of the rotor 14 and end housing 90, respectively, upstream of the seal 50, $P_h$ is normally substantially higher than the downstream pressure $P_l$ on the second side of the annular seal 50. If $F_s$ is the total spring load, then the total loading force is $F_s + A_2 (P_h - P_l)$ where $A_2$ is the area of the surface of the rail 68. While the total loading force is absorbed by the combined bearing action of the rails 66 and 68, the surface of rail 66 is a seal stabilizing area and the surface of the rail 68 is the actual seal working surface.

As the fluid power converter 10 operates at varying speeds and loads, minute changes in the clearance between the rotor sides 40 and the side plate sides 42 occur because of pressure deflection or because of small normal misalignment of the working parts. Changes in the clearance between the sides 40 and 42 is accommodated by corresponding small changes in the axial position of the seal 50 as it moves against the loading force of the fluid pressure and springs 62 so that proper contact of the seal face 64 with the side 40 is maintained. The eccentric mounting of the seal 50 results in all segments of the seal face 64 continuously and periodically changing radial position in an in-and-out fashion. This periodic radial motion of the seal 50 provides lubrication of the seal face 64 thereby preventing the seal from wearing out and also prevents the seal from wearing a groove in the rotor side 40. The fit of the seal 50 around the retainer ring 54 provides sufficient clearance for axial motion of the seal 50 but is limited to insure proper operation of the O-ring seal 60 between the seal 50 and the retainer ring 54.

Figure 5:
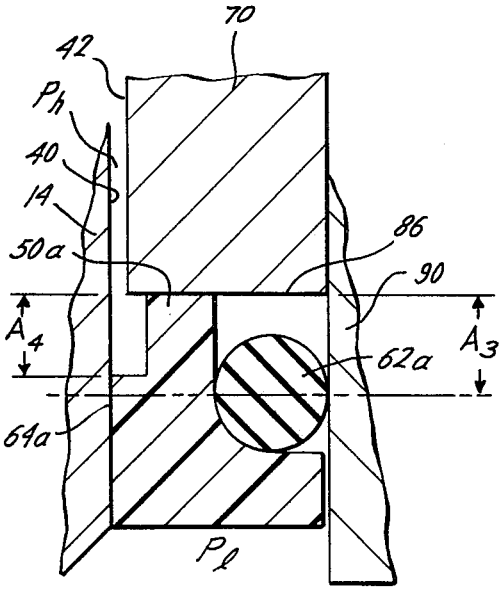
FIG. 5 is an enlarged fragmentary elevational view, in cross section, of a further embodiment of the present invention.

Referring now to FIG. 5, a modified seal embodiment is shown which is useful for small hydraulic motors or pumps where the preferred embodiment of FIG. 4 is difficult to install. In FIG. 5, the seal **50*a* is located in an eccentric opening 86 in the side plate 70 and its seating face 64*a* is resiliently loaded against the side 40 of the rotor 14 by the compliance of resilient means 62*a* such as an O-ring which permits slight axial motion of the seal face 64*a* towards the side 40, but yet prevents leakage of fluid around the backside of the seal 58. The seal 50*a* is pressure loaded into the rotor side 40 by a force equal to the net area $(A_3 - A_4)$ times the pressure differential $(P_h - P_l)$. It should be noted here that the area $A_3$ will change slightly as operating conditions change resulting in extrusion of the O-ring 62*a* toward the axis of the converter 10**.

Figure 6:
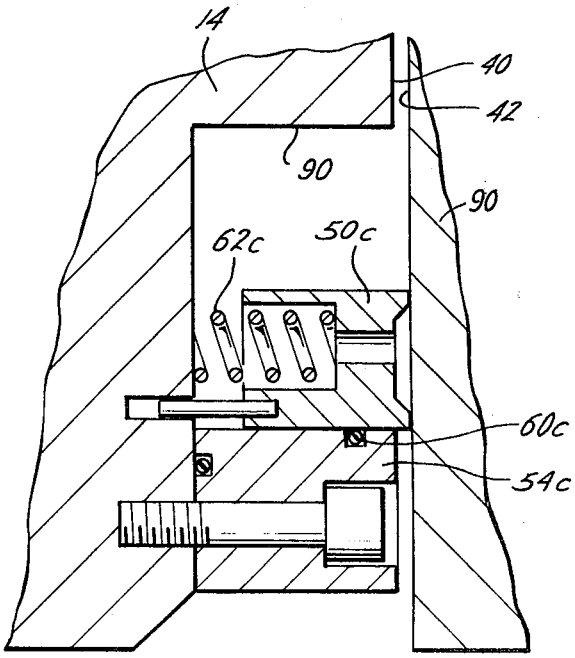
FIG. 6 is an enlarged fragmentary elevational view, in cross section, of a further embodiment of the present invention.

Still a further embodiment of the present invention is shown in FIG. 6 which is similar to the preferred embodiment of FIG. 4 with the exception that the seal **50*c* and retainer ring 54*c* are positioned in a recess 90 in the rotor 14 and the seal 50*c* then acts and is loaded against the end housing 90**.

The present invention, therefore, is well adapted to carry out the objects and attain the ends and advantages mentioned as well as others inherent therein. While presently preferred embodiments of the invention are given for the purpose of disclosure, numerous changes in the details of construction and arrangement of parts will radily suggest themselves to those skilled in the art and which are encompassed within the spirit of the invention and the scope of the appended claims.

What is claimed is:

1. In a fluid power converter having a rotor and a stator member, the members being concentrically mounted and rotatable one with respect to the other about a common axis and having coacting sides, the improvement in seal means between said sides comprising, an annular retainer ring sealably connected to the first of said members, an annular first seal positioned between the coacting sides of said members and coaxially positioned about the retainer ring, means securing said annular seal to said first member for preventing rotation relative to said first member, but allowing movement of said annular seal towards said second member, said first seal including two annular rails protruding toward said second member, resilient means between said annular seal and said first member yieldably urging said annular rails of said annular seal toward said second member, said seal being of a width less than the distance between the coacting sides whereby high pressure between the coacting sides acts on the end of said seal to urge said seal towards the second member, said seal including a passageway extending from between said rails to a position between the coacting sides, and a second seal means between the outside of the retainer ring and the inside of said annular seal whereby the total loading force on the first seal is borne by both rails but only the inner rail acts as a seal.

2. The apparatus of claim 1 wherein said second seal is positioned closer to the second member than the first member.

3. The apparatus of claim 1 wherein the center of the retainer ring and first annular seal is eccentrically positioned relative to the common axis whereby the seal continuously and periodically changes its radial sealing contact with the second member.

* * * * *